US005848762A

United States Patent [19]

Reinheimer et al.

[11] Patent Number: 5,848,762

[45] Date of Patent: Dec. 15, 1998

[54] ADAPTER FOR TOILET PAPER ROLLS WITHOUT CORE

[75] Inventors: Horst Alfred Reinheimer, Kelkheim; Christof Karl Stary, Eckental, both of Germany

[73] Assignee: The Procter & Gamble Company, Cincinnati, Ohio

[21] Appl. No.: 894,982

[22] PCT Filed: Mar. 1, 1996

[86] PCT No.: PCT/US96/02770

§ 371 Date: Feb. 5, 1998

§ 102(e) Date: Feb. 5, 1998

[87] PCT Pub. No.: WO96/27546

PCT Pub. Date: Sep. 12, 1996

[30] Foreign Application Priority Data

Mar. 3, 1995 [DE] Germany ..... 29503573 U

[51] Int. Cl.[6] ..... B65H 19/00

[52] U.S. Cl. ..... 242/595; 242/598

[58] Field of Search ..... 242/598, 598.5, 242/598.6, 595

[56] References Cited

U.S. PATENT DOCUMENTS

| | | | |
|---|---|---|---|
| 1,436,990 | 11/1922 | Lillibridge . | |
| 3,848,822 | 11/1974 | Boone | 239/52 |
| 4,427,159 | 1/1984 | Miller et al. . | |
| 4,721,264 | 1/1988 | Muscarello | 206/390 |
| 5,172,966 | 12/1992 | Myatt . | |
| 5,248,105 | 9/1993 | Cooker | D6/519 |
| 5,255,800 | 10/1993 | Kelly | 211/89 |
| 5,464,170 | 11/1995 | Mitchell et al. | 242/598 |

FOREIGN PATENT DOCUMENTS 0 122 809 10/1984 European Pat. Off. .

*Primary Examiner*—John P. Darling

*Attorney, Agent, or Firm*—Vladimir Vitenberg; Larry L. Huston; E. Kelly Linman

[57] ABSTRACT

An adapter (1) for dispensers receiving coreless toilet paper rolls (3) having a receptacle (2) into which to place a coreless toilet paper roll (3) and at least one suspension arrangement (8) for fastening the adapter (1) to conventional mountings (9) of wall mounted dispensers (10) use for core-type toilet paper rolls.

8 Claims, 1 Drawing Sheet

ADAPTER FOR TOILET PAPER ROLLS WITHOUT CORE

The invention relates to an adapter for dispensers receiving coreless toilet paper rolls.

Conventionally, toilet paper is wound up on board cores so as to facilitate the mechanical winding operation and to obtain an accurately wound roll.

There has been a tendency of late, in particular with multipacks of toilet paper rolls, to keep the volume to be packaged as low as possible. This helps strongly reduce the packaging cost as such and the fees of participation in centralized dumping such as the "Duales System Deutschland" (keyword: "Grüner Punkt")*. Moreover, it is generally desirable to reduce the use of packaging material with a view to reducing the quantities of garbage.

The most efficient measure for the reduction of packaging material, in particular with multipacks of toilet paper rolls, is offered by the reduction in size of the toilet paper rolls by omission of the cores. If a web of toilet paper of constant length and number of sheets is rolled on itself virtually without any open core, then the diameter of a toilet paper roll and thus the required packaging volume can be reduced considerably. However, there is the problem that most dispensers used for toilet paper rolls need the open core for the fastening of the roll, the open core of the toilet roll being placed on corresponding holders. Such dispensers are not suitable for coreless toilet paper rolls, they would have to be replaced. Since the majority of consumers will very much dislike such an exchange and the costs and efforts implied, it is to be assumed that coreless toilet paper rolls will not successfully meet with a ready market.

Proceeding from these problems, it is the object of the invention to create a possibility for coreless toilet paper rolls to be used on conventional dispensers.

This object is attained by the adapter herein disclosed. To this end, the adapter has a receptacle, into which to place a coreless toilet paper roll, and at least one suspension arrangement for it to be fastened to conventional mountings of dispensers used for core-type toilet paper rolls.

Owing to this design, the conventional mounting available in toilets can still be used by the adapter being applied, the latter's receptacle accommodating the toilet paper roll.

Fundamentally, the adapter can be distributed in the scope of household supplies as a comparatively simple retrofit article to be manufactured at a low cost, or it can be added as an advertising supplement to multipacks of coreless toilet paper rolls. In this regard, the adapter will increase the acceptance of consumers towards the novel coreless toilet paper rolls, thus supporting the distribution of these environmentally acceptable rolls.

Figure 1:
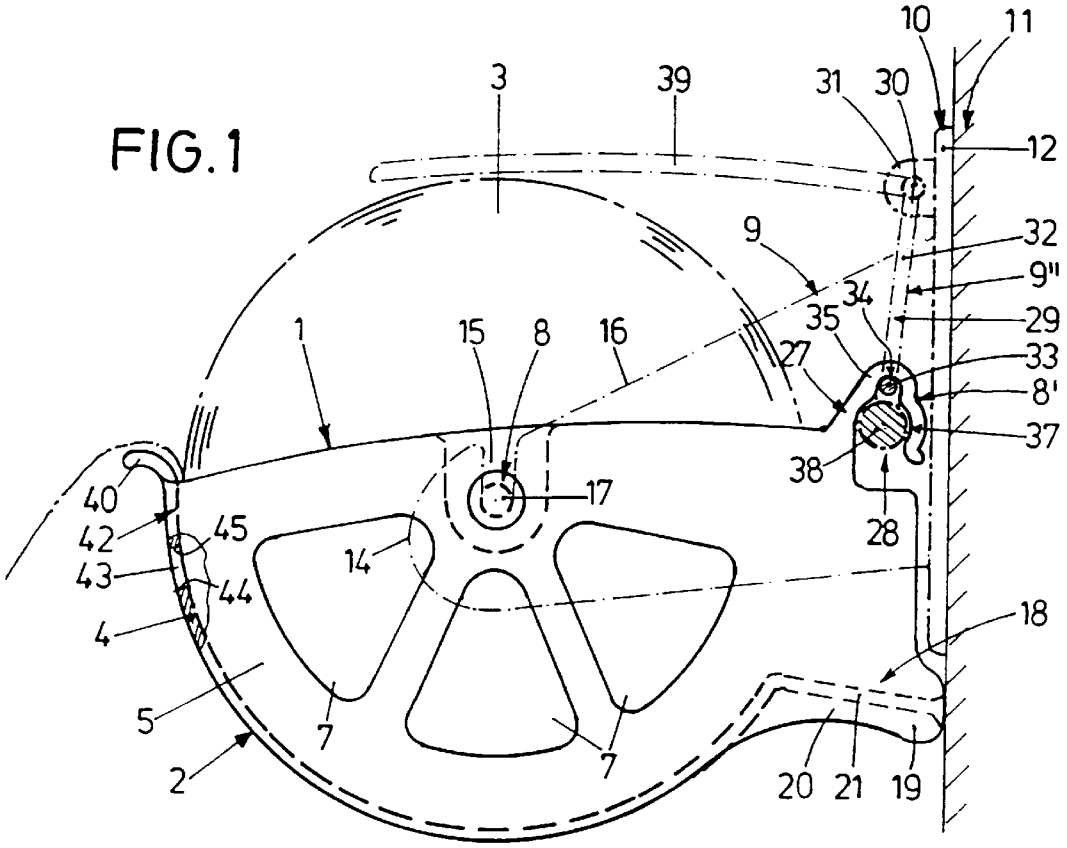
Figure 2:
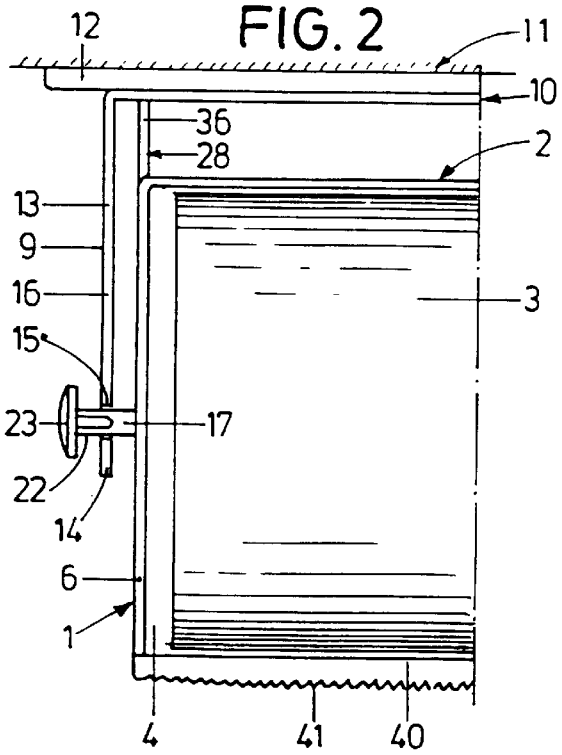
Figure 3:
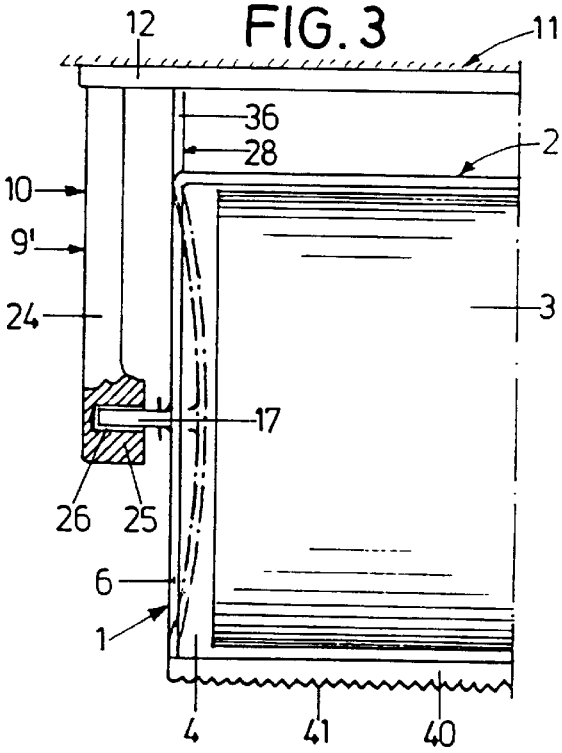

Further features, details and advantages embodiments of the adapter according to the invention will become apparent from the subclaims and the ensuing description of an exemplary embodiment of the subject matter of the invention, taken in conjunction with the attached drawings, in which FIG. 1 is a lateral view of an adapter with several dispensers of conventional design being roughly outlined, and FIGS. 2 and 3 are plan views of the adapter in its position of mounting on different dispensers.

As seen in FIGS. 1 to 3, the adapter 1 in the form of an injection-molded part has a substantially semicylindrical receptacle 2 open to the top, into which to place a coreless toilet paper roll 3. The receptacle 2 comprises a semicylindrical casing wall 4 and approximately semicircular sidewalls 5, 6, which finish the receptacle 2 laterally. The sidewalls 5, 6 are provided with several triangular recesses 7 for material saving purposes.

Further, the adapter 1 is provided with various suspension arrangements 8, 8', by means of which it can be fastened to conventional mountings 9, 9', 9" of wall-mounted toilet paper dispensers 10. As a rule, such wall-mounted dispensers 10 have a fastening plate 12, which must be applied over its full surface on a wall 11, and from which the actual holding elements stick out. A typical wall-mounted dispenser 10 is shown by dash-dotted lines in FIG. 1 and illustrated in FIG. 2. Its mounting 9 consists of two lateral sheet metal brackets 13 of vertical direction, which project at right angles over the fastening plate 12, and which, viewed laterally, are substantially triangular, having a rounded free end 14. Upstream of this free end 14, the brackets 13 each have a bearing slot 15 open to the top and extending vertically, into which to place from above the axle stubs of a bearing spindle that passes through the core of a conventional toilet paper roll.

On its sidewalls 5, 6, the adapter 1 comprises insert pins 17, which are in alignment with each other axially and which stick out from the side walls 5, 6 centrally before of the upper edge 16; they can be inserted into the bearing slot 15 instead of the axle stubs. Thus the adapter 1 can be fastened to this type of wall-mounted dispenser 10. So as to secure the position, shown in FIGS. 1 and 2, of the adapter 1, the lower wall-side edge portion 18 of the latter's receptacle 2 has supporting projections 19 formed by elongation pieces 20 and 21 integrally formed on the sidewalls 5, 6 or on the casing wall 4, respectively. As shown in FIG. 1, when the adapter 1 of the present invention is fastened to the wall-mounted toilet paper dispenser 10, the elongation pieces 20, 21 preferably bear against the wall 11 to which the wall-mounted dispenser 10 is mounted, to provide support for the adapter 1.

As seen in FIG. 2, the free ends 22 of the insert pins 17 can be provided each with a detachable cap 23 projecting over the diameter of the pin.

FIG. 3 illustrates how, by means of its insert pins 17, the adapter 1 can be hooked in another type of mounting 9'. This other type of mounting 9' consists of two solid brackets 24, which again project horizontally and at right angles over the fastening plate 12, and of which only one is seen in FIG. 3. The free ends of the brackets 24 are provided with thickened heads 25 that have bottom holes 26 left open inwards. These bottom holes 26 can accommodate the ends of a telescopable bearing axle of a conventional spindle taking up conventional core-type toilet paper rolls.

In exchange for this spindle, the adapter 1 can be suspended in these bottom holes 26 with the aid of its insert pins 17, the latter being disposed on the sidewalls 5, 6 flexible to the inside of the receptacle 2. For the insertion of the adapter 1 into the mounting 9', the two sidewalls 5, 6 only have to be pressed inwards towards each other for the insert pins 17 to snap into the bottom holes 26.

As seen in FIG. 1, further measures have been taken on the adapter 1 for the latter to be assembled with other types of mountings 9". For instance, the upper wall-side edge portion 27 of the receptacle 2 is provided with hook-in-type eyelets 28, by means of which the adapter 1 can be hooked in the usual, U-shaped and pivotable bow holders 29 of conventional toilet paper dispensers. FIG. 1 illustrates such a bow holder 29 bent from wire, of which the upper leg 30 is retained horizontally in a pivot bearing 31 on the fastening plate 12. The brace 32 forming the base of the U-shaped bow holder 29 extends approximately at right angles downwards and passes into the lower leg 33 of the bow holder 29 which engages with the core of conventional toilet paper rolls.

When the adapter 1 is used, this lower leg 33 lodges in a hook-in-type eye 34 of reduced size of the hook-in-type eyelets 28. The latter are level with the two sidewalls 5, 6 by arms 35, 36 being integrally formed on the latter.

For the assembly of the adapter 1 not only with thin bow holders 29 bent from wire, but with thicker, plastic injection molded bow holders, the hook-in-type eyelets 28 have a hook-in-type eye 37 of increased size in addition to the hook-in-type eye 34 of reduced size. In FIG. 1, the lower leg 38 of such a thicker bow holder is outlined by a dot-dashed line.

As further seen in FIG. 1, the adapter 1 may be used even with wall-mounted dispensers that have a holding-down plate 39 for the toilet paper roll 3.

The outlet-side edge 40 of the receptacle 2 is in the form of a tear-off edge, as roughly outlined by the teeth 41 seen in FIGS. 2 and 3. Further, in the outlet-side portion 42 of the casing wall 4 of the substantially semicylindrical receptacle 2, provision is made for a passage 43 extending over the width of the toilet paper roll 3 and through which to pull the paper web. The two edges 44, 45 defining the passage 43 to the top and to the bottom serve as a tear-off edge.

What is claimed is:

1. An adapter for a toilet paper roll dispenser, the adapter comprising:

a substantially semi-cylindrical receptacle, open at the top and designed to receive a coreless toilet paper roll therein, the receptacle comprising a pair of mutually opposite sidewalls and a semi-cylindrical casing wall disposed between the sidewalls and designed to support the coreless toilet paper roll; and at least one suspension arrangement for fastening the adapter to a wall-mounted toilet paper dispenser, the suspension arrangement comprising two axially-aligned insert pins, each of the pins extending outwardly from each of the sidewalls and having a free end.

2. The adapter according to claim 1, wherein the casing wall terminates with an outlet-side edge designed to serve as a tear-off edge for tearing off the toilet paper.

3. The adapter according to claim 1, wherein the casing wall has an orifice for passage of the toilet paper therethrough.

4. The adapter according to claim 1, wherein at least one of the free ends of the insert pins has a detachable cap thereon.

5. The adapter according to claim 1, wherein at least one of the sidewalls is flexible to be inwardly deflected into the receptacle for insertion of the adapter into the wall-mounted toilet paper dispenser.

6. The adapter according to claim 1, wherein each of the sidewalls comprises a hook-in-type eyelet.

7. The adapter according to claim 6, wherein the hook-in-type eyelet comprises a first hook-in-type eye and a second hook-in-type eye greater than the first hook-in-type eye.

8. The adapter according to claim 1, further comprising at least one supporting projection formed on a lower portion of the receptacle, the supporting projection comprising an elongation piece designed to bear against a wall to which the wall-mounted toilet paper dispenser is mounted.

* * * * *